United States Patent [19]

Bakermans et al.

[11] Patent Number: 4,974,479

[45] Date of Patent: Dec. 4, 1990

[54] PUNCH AND DIE SET HAVING IMPROVED SLUG MANAGEMENT SYSTEM

[75] Inventors: Johannes C. W. Bakermans, Harrisburg; John D. Deimler, Middletown, both of Pa.; Ronnie W. Reavis, Lewisville, N.C.

[73] Assignee: AMP Incorporated, Harrisburg, Pa.

[21] Appl. No.: 425,265

[22] Filed: Oct. 20, 1989

[51] Int. Cl.[5] ..... B26D 5/20; B26D 7/18

[52] U.S. Cl. ..... 83/145; 83/149; 83/93

[58] Field of Search ..... 83/145, 148, 149, 162, 83/449, 86, 93, 151; 72/344

[56] References Cited

U.S. PATENT DOCUMENTS

| | | | |
|---|---|---|---|
| 382,911 | 5/1888 | Shipley | 83/93 |
| 3,195,386 | 7/1965 | Daniels | 83/162 |
| 3,938,413 | 2/1976 | Goettel et al. | 83/145 |
| 4,327,571 | 5/1982 | Cavanaugh | 72/344 |
| 4,821,615 | 4/1989 | Bakermans et al. | 83/147 |

FOREIGN PATENT DOCUMENTS

| | | | |
|---|---|---|---|
| 117755 | 11/1943 | Australia | 72/344 |
| 2184968 | 7/1987 | United Kingdom | 83/86 |

*Primary Examiner*—Frank T. Yost
*Assistant Examiner*—John M. Husar

[57] ABSTRACT

System for controlling slugs (10, 10') in a stamping and forming machine has a slug stripper (32) for stripping slugs from the end (13) of the punch (11) and slug supporting bars (78, 80) which support slugs at their edges as they move through a passageway (82). The slug stripper (32) is mounted in the facial surface (18) of the die plate (14) and has an end portion (56) which extends partially over the die opening (44). When the punch (11) descends and punches a notch (8) in the strip material (2), the slug (10, 10') which is produced moves the stripper (32) to a retracted position. When the slug (10, 10') is moved past the end of the slug stripper (32), the slug stripper returns to its normal position so that on the return stroke of the punch the slug will be removed by the end portion (58) of the stripper. The slugs are maintained in a stack in the slug passageway (82) by opposed supporting bars (78, 80) which are resiliently biased against opposite edges of the slugs.

18 Claims, 7 Drawing Sheets

FIG. 6
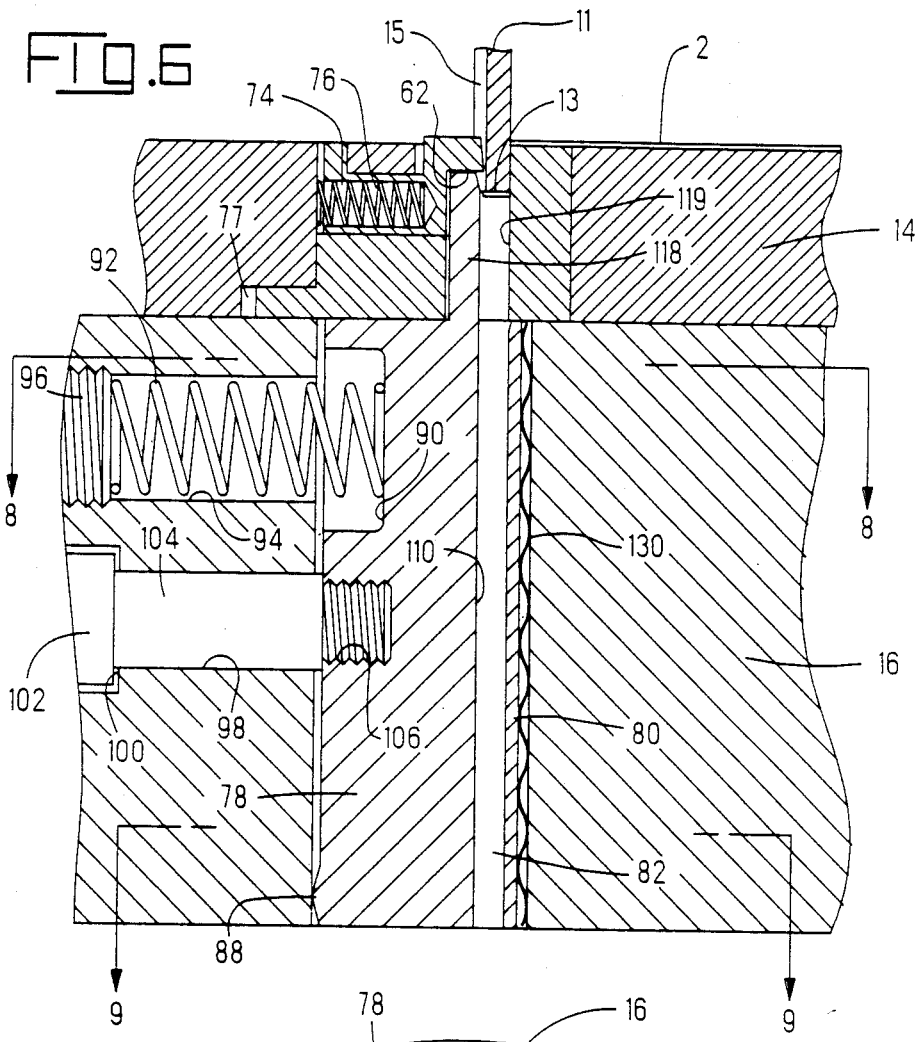
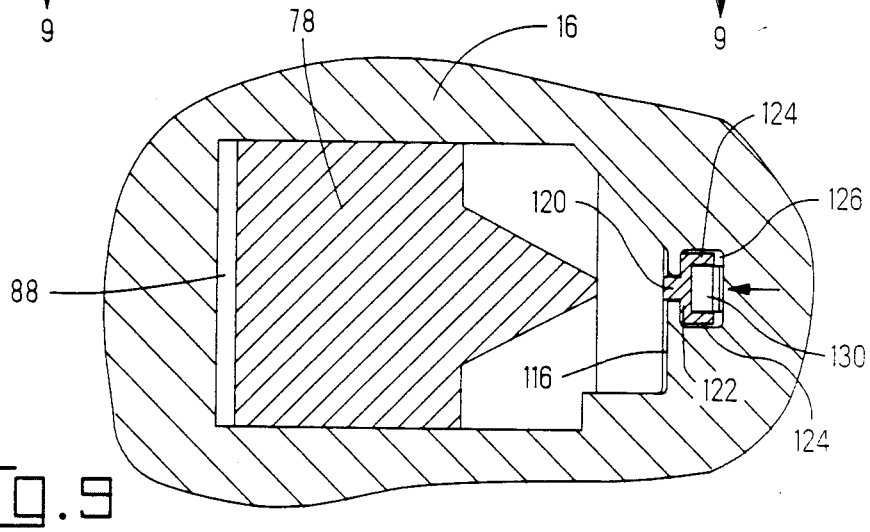
FIG. 9

PUNCH AND DIE SET HAVING IMPROVED SLUG MANAGEMENT SYSTEM

FIELD OF THE INVENTION

This invention relates to machines for performing punching operations on strip material and particularly to a system for controlling the movement of the slugs, which are produced when a punching operation is carried out, in the die assembly and for disposing of the slugs produced.

RELATED U.S PATENTS

U.S. Pat. Nos. 4,497,196, 4,819,476, and 4,809,576 show features of a type of stamping and forming machine in which the present invention can be used. These U.S. patents are hereby incorporated by reference.

BACKGROUND OF THE INVENTION

When an opening is formed in a strip of material by a conventional punch press, a slug of scrap material which conforms in shape to the shape of the opening is produced during each operating cycle and these slugs must be removed from the vicinity of the punch and die as they are produced. When the punching operation is carried out with a conventional press having a punch on a reciprocable ram and a fixed die, with the punch and die extending vertically, the slugs produced are pushed into a passageway from the die opening and the passageway extends vertically to a suitable receptacle for the scrap slugs. If the slugs are relatively heavy, they will fall by gravity through the passageway, which can be made oversized relative to the slugs, and disposal of the slugs does not present any serious problems. However, if the slugs are relatively small and have a very slight mass, they will have a tendency to adhere to the sides of the passageway and bridge across the passageway thereby blocking it against the passage of additional slugs. As a result, a large number of compacted slugs will build up in the passageway beneath the die opening. This condition can result in the entire passageway being filled with slugs so that at some point, the punch may be broken as it attempts to push a recently-produced slug onto the compacted mass of slugs in the passageway and in the die opening.

The problem of compacting of the slugs is complicated if the opening in the strip material is formed as a notch in the edge of the material rather than as a centrally located hole in the material. When the strip is notched in a punching operation, the slugs will be of varying size from one reel of coiled strip material to another for the reason that the width of the strip will vary from one reel to another within the tolerance limits which are set for a particular strip specification. For example, the width of metal strip used in a stamping operation may vary as much as plus or minus (±) 0.002 inches (0.051mm) so that the overall variation in width as between the .narrowest and the widest strips will be 0.004 inches (0.101mm). Since the slugs are produced from the edge of the strip, the size of the slugs will similarly vary from one reel of material to another. The passageway must be large enough to accommodate the largest slugs which will be produced plus a slight clearance so that the largest slugs can move freely through the passageway. If, however, relatively small slugs are being produced from relatively narrow strip material, the possibility of jamming or packing of the slugs in the passageway is increased.

In the discussion presented above, it is assumed that the press is vertically mounted and that the slugs will fall under the influence of gravity. U.S. Pat. No. 4,497,196 shows a stamping and forming machine in which the punch and die assemblies are mounted horizontally for a relative movement toward and away from each other. In machines of this type, the slug passageway must extend horizontally through the die assembly and the influence of gravity is not available for slug removal purposes.

A further problem which is sometimes encountered in punching operations is that of adherence of a slug to the punch when the punch returns to its normal position after carrying out a punching operation. If the slugs are of small mass and have a thin film of lubricant on them, the lubricant on the slugs and on the punch may cause the slugs to adhere to the punch due to surface tension effects. If such adherence occurs, during the next operation cycle, the punch will move the adhered slug against the stock material and encounter increased forces as it moves downwardly and pushes the slug against the stock which is positioned over the die opening. This condition can cause breakage of the punch and in any event, requires that the press be stopped and the jam in the punch be cleared.

The problems of slug adherence to the punch and compacting of the slugs in the slug passageway can be obviated in a conventional press by providing a suction system in the slug passageway so that the slugs will be drawn by a flow of air through the slug passageway to the outlet of the slug passageway. These suctions systems are effective; however, they occupy space in the die assembly and require compressed air lines in regions of the press where compressed air is otherwise not required. Also, it is impractical to provide suction systems in stamping and forming machines of the type described in U.S. Pat. No. 4,497,196.

The present invention is directed to the achievement of an improved slug removal and controlling system which obviates the above problems encountered in the management of control of slugs in a stamping and forming machine.

THE INVENTION

One embodiment of the invention comprises a punch assembly and a die assembly which are intended for mounting in a press. The punch and die are shaped for punching notches in one edge of a strip of material which is intermittently fed along a strip feed path which extends between the punch and die assemblies. The die assembly has a facial surface and has a die opening extending into the facial surface. A slug receiving passageway extends through the die assembly from the die opening to a slug outlet. The punch assembly is in opposed relationship to the die assembly and has a punch extending therefrom. The punch has a free end which is dimensioned to be received in the die opening. The punch and die assemblies are reciprocable towards and away from each other between open and closed positions and the strip feed path extends between the punch and die assemblies and partially over the die opening so that upon reciprocation of the punch and die assemblies relatively towards and away from each other, a slug will be punched from one edge of the strip by the free edge of the punch and will be pushed into the die opening. The punch and die assemblies are characterized in that a slug stripper is provided for ensuring that a slug does not adhere to the free end of the punch when the punch assembly returns to its open position and a slug supporting means is provided in the passageway and in the die opening for preventing compacting of the slugs in the passageway. The slug stripper is mounted in the facial surface of the die assembly and is resiliently biased to a normal position in which an end portion of the slug stripper extends partially across the die opening. The slug stripper is retractable to a retracted position and the punch has a recess therein which is located and dimensioned such that it will receive the end portion of the slug stripper. The slug supporting means extends from a location adjacent to the die opening through the passageway towards the slug outlet whereby during continuous operation of the press, any slugs which may adhere to the punch will be stripped from the free end thereof by the slug stripper and the slugs in the passageway will be maintained in parallel planes in an orderly stack.

In accordance with a further embodiment, the die opening overlaps the strip feed path and the die opening and the passageway have a first side which is beside, and spaced from, the strip feed path and a second side which is on the strip feed path. The slug supporting means comprises a first slug supporting bar which extends along the first side of the passageway to the outlet, the first bar being resiliently biased towards the second side whereby slugs in the passageway are urged against the second side by the first bar. In the preferred embodiment, a second slug supporting bar is provided which extends axially along the passageway along the second side thereof. The second slug supporting bar is resiliently biased towards the first slug supporting bar so that slugs in the passageway are supported between the first and second slug supporting bars. The first slug supporting bar preferably is pivoted at a location spaced from the die opening and has an extension which extends into the die opening.

The slug stripper is mounted in the die assembly at a location beside the strip feed path and has an end portion which normally extends laterally of the strip feed path and partially across the die opening. The slug stripper is resiliently biased to its normal position and is retractable to its retracted position. The punch has a recess extending from its free end partially along its length which is located and dimensioned to receive the end portion of the slug stripper so that in the event that a slug does adhere to the end of the punch, the slug stripper will enter the recess in the punch and thereby be located above the one surface of the slug. As the punch returns to its normal position, the slug stripper will remove the adhered slug from the end of the punch.

THE DRAWING FIGURES

FIGS. 6 and 7 are views similar to FIG. 6 showing the positions of the punch at different stages of the operating cycle.

FIG. 9 is a view looking in the direction of the arrows 9—9 of FIG. 6.

THE DISCLOSED EMBODIMENT

Figure 10:
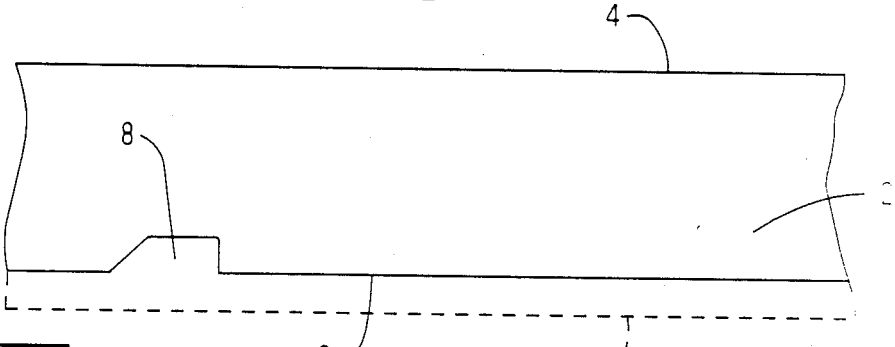
FIG. 10 is a plan view of a strip of material having notches punched in one side edge thereof.
Figure 11:
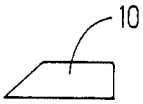
FIGS. 11 and 12 show the slugs which are produced from the strip as a result of the punching operation.
Figure 12:
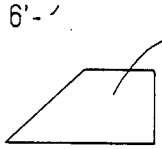

FIGS. 10–12 illustrate the conditions which can give rise to serious problems of slug packing or slug jamming in the slug passageway of a stamping and forming machine. FIG. 10 shows a strip 2 of material having parallel side edges 4, 6. Notches 8 have been punched from the side edge 6 and each notch, when formed, produces a slug 10 which is sheared from the side edge and pushed from the material through the die opening to the slug passageway. The strip material 2 will have a nominal width between the edges 4 and 6; however, from one reel of material to another, the actual width will vary within the tolerance limits which are specified for the particular strip material being used. For example, a specification will require that a strip be of the nominal width plus or minus (±) 0.002 inches (0.051mm). If the side edge 6 is taken as a side edge of a strip of minimum width, then the side edge 6' can be assumed to be the side edge of a maximum width strip. When the side edge is at 6' rather than at 6, the slug 10' shown in FIG. 12 will be considerably larger than the slug 6 shown in FIG. 11. The relative width of the strip and sizes of the slugs 10, 10' are greatly exaggerated in FIGS. 10–12 for purposes of illustration. However, a difference of even 0.004 inches (0.101mm) or less between the smallest and the largest of the slugs produced gives rise to vexatious problems of die design. The passageway through which the slugs must pass must be large enough to accommodate the largest slug produced, the slug 10' with a slight clearance; as a result, the smallest slug produced, the slug 10, will have a relatively generous clearance in the passageway. The smaller slugs particularly may tumble and become compacted in the passageway and damage to the press can result as explained above. The practice of the present invention avoids compacting of slugs in the passageway of the die assembly as well as the adherence of slugs to the end of the punch.

Figure 1:
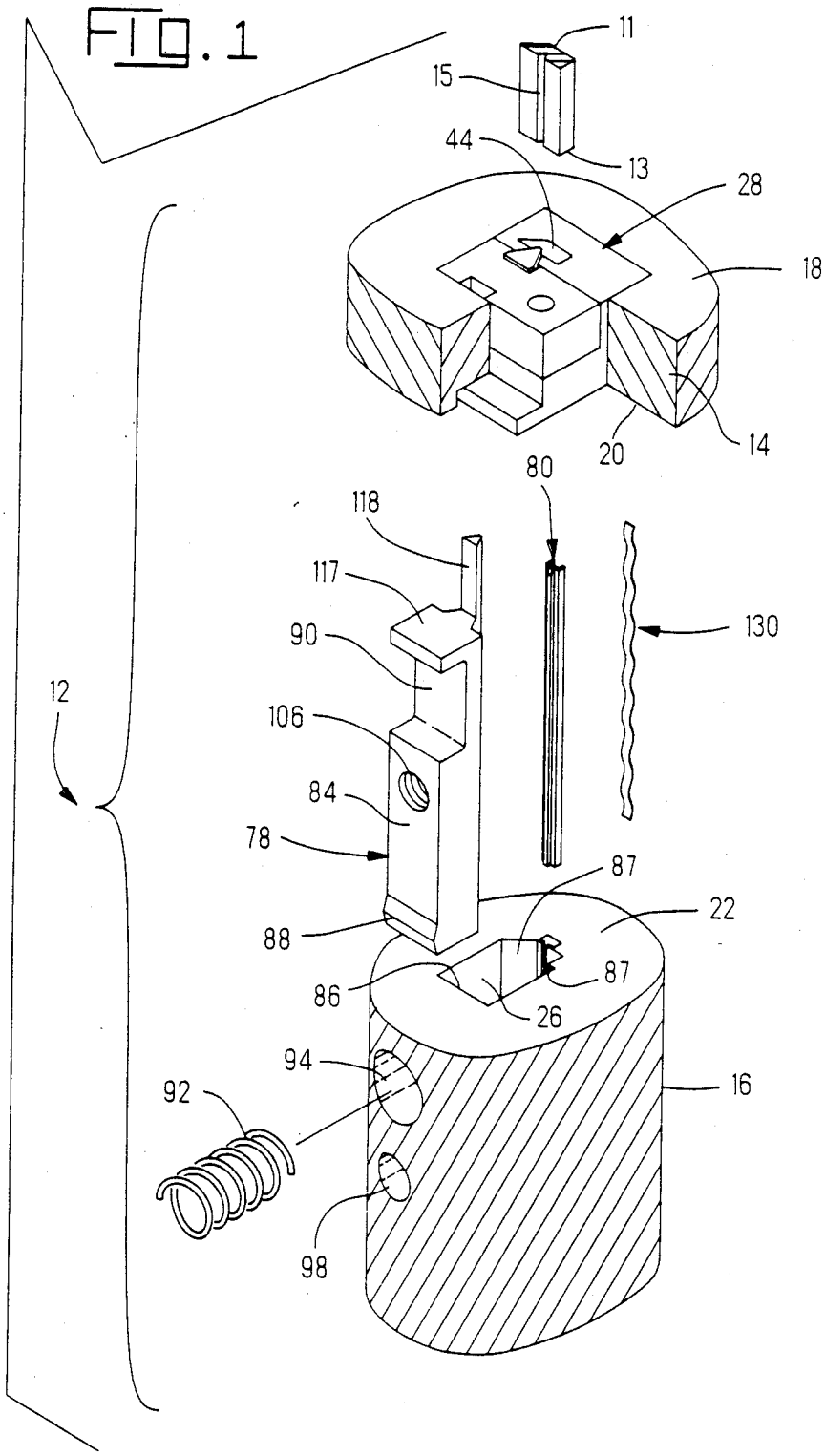
FIG. 1 is a perspective view of the parts exploded from each other of a punch and die set in accordance with the invention.
Figure 2:
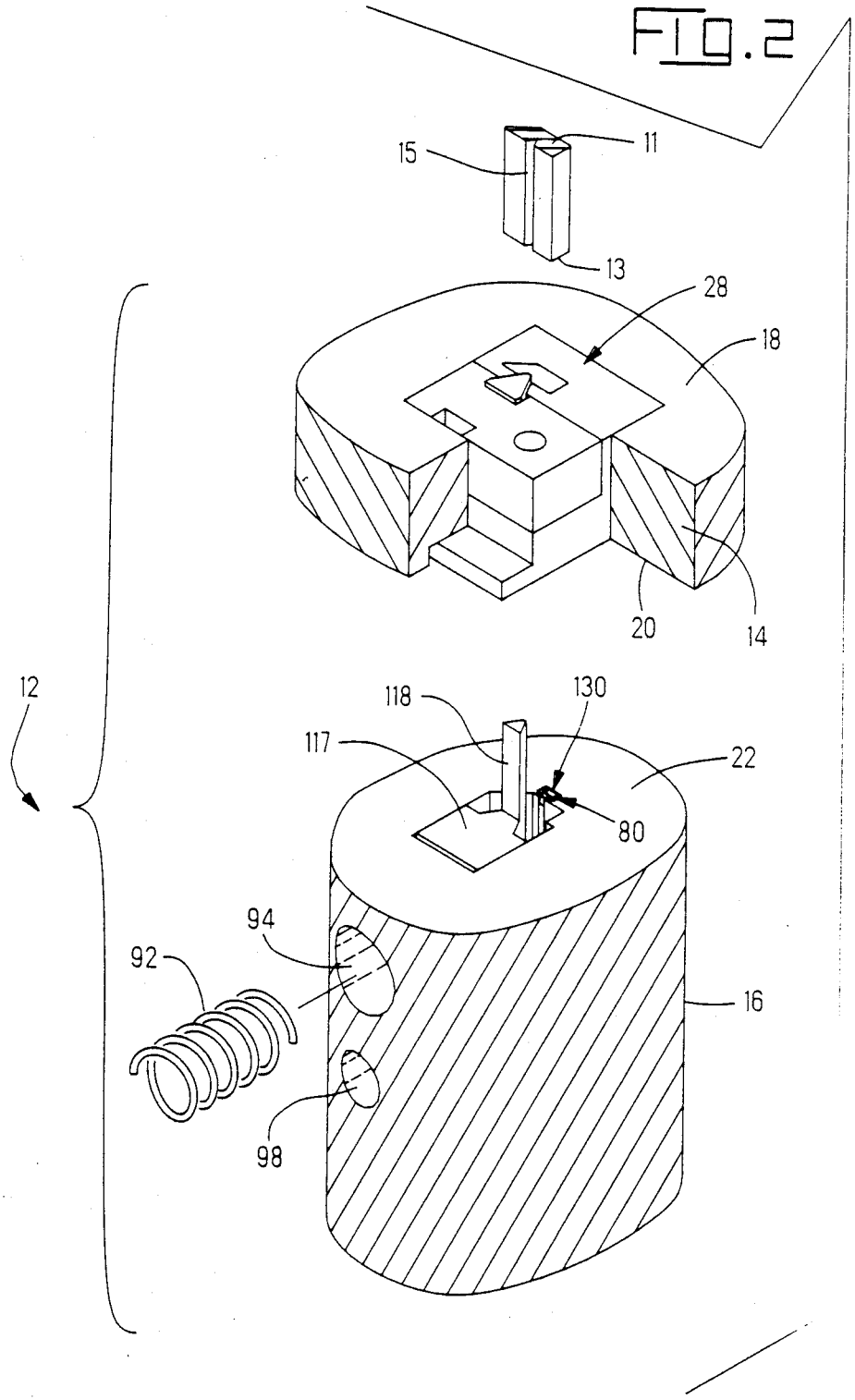
FIG. 2 is a view similar to FIG. 1 but with the parts partially assembled.
Figure 3:
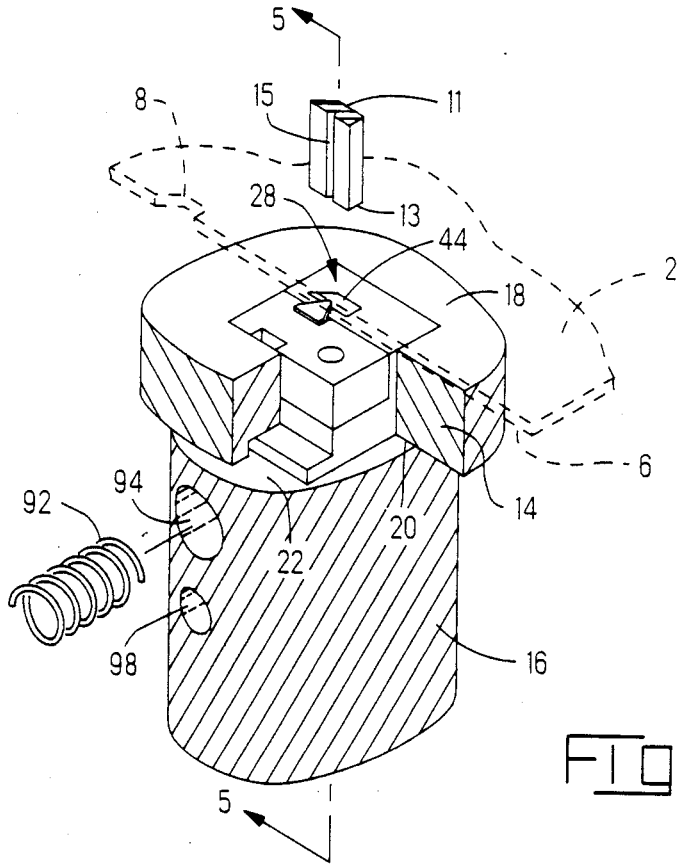
FIG. 3 is a view showing the die assembly fully assembled.

A punch 11 and die assembly 12 are shown in FIGS. 1–3. The punch 11 will extend from a punch assembly which is not specifically shown but which may be of the type described in detail in the above-identified U.S. Pat. No. 4,819,476. A triangular groove or recess 15 extends from the end 13 of the punch partially along its length for the reception of a portion of the slug stripper as described below. The die assembly 12 comprises a die plate 14 and a die backup plate 16. The die plate has a facial surface 18 which is opposed to the punch and a reverse surface 20 which is against the upper surface 22, as viewed in FIG. 1, of the backup plate 16. A square hole 24 (FIG. 4) extends through the die plate and an irregularly shaped hole 26 extends through the backup plate 16.

Figure 4:
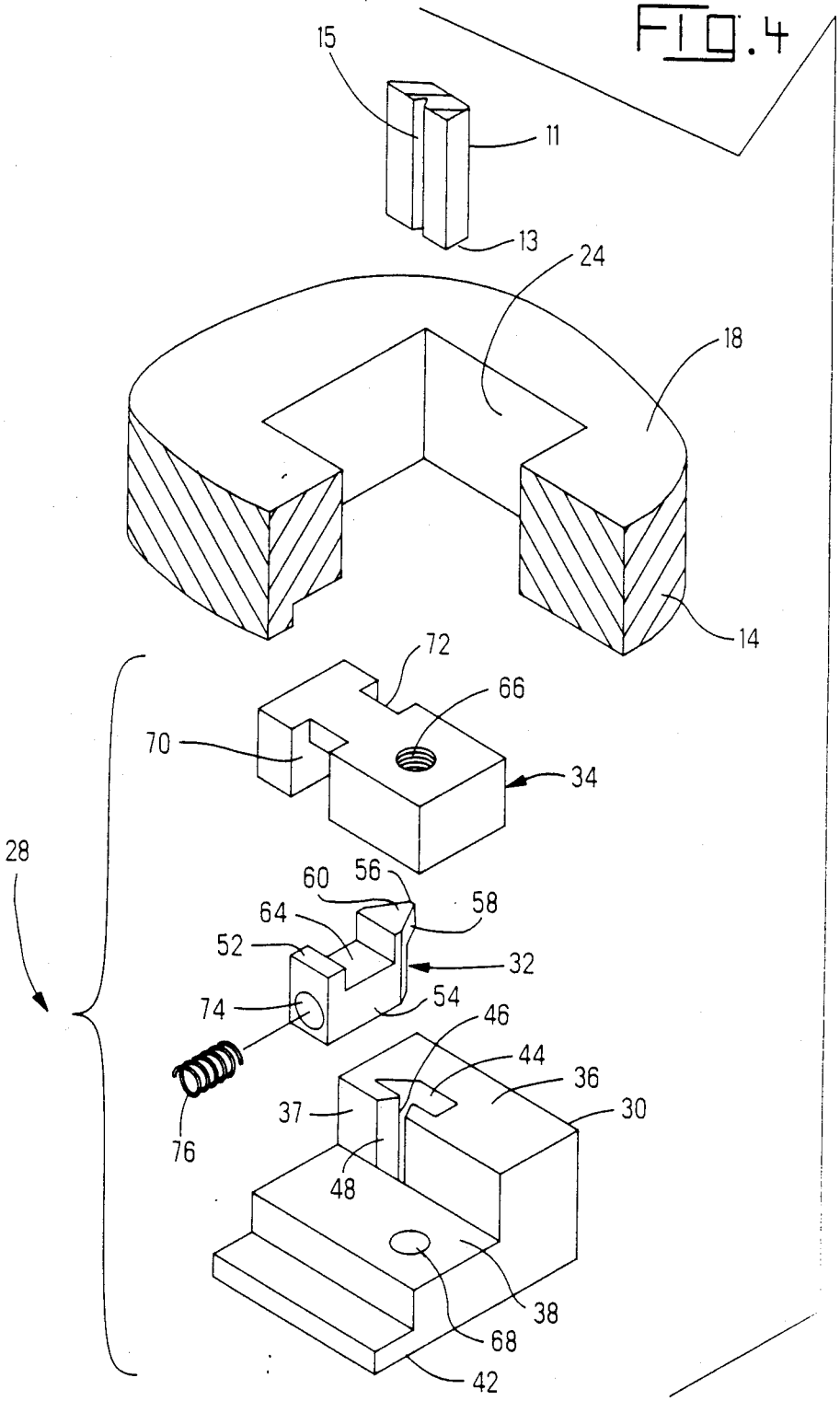
FIG. 4 is an exploded perspective view showing the die insert of the die assembly.

A die insert assembly 28 shown in FIG. 4 is mounted in the square hole 24 and comprises a die insert block 30, a slug stripper 32, and a retaining block 34. The insert 30 has an upwardly facing surface 36 and a surface 38 which is below the upper surface 36, a side surface 37, and a projecting lip 42. The die opening 44 extends downwardly from the surface 36 and a slot 46 is provided which opens into the die opening from the side surface 37, the side walls 48 of this slot being convergent.

Figure 5:
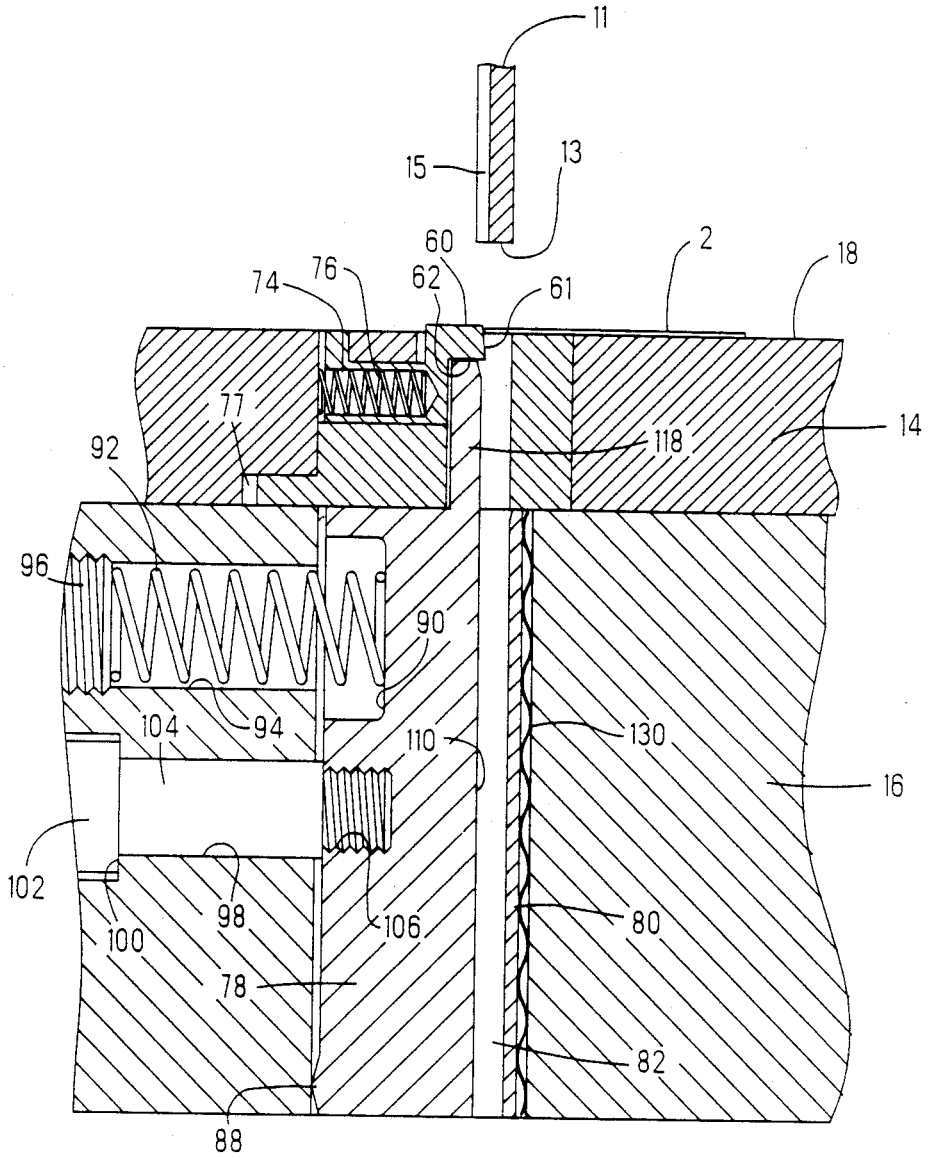
FIG. 5 is a sectional view looking in the direction of arrows 5—5 of FIG. 3.
Figure 7:
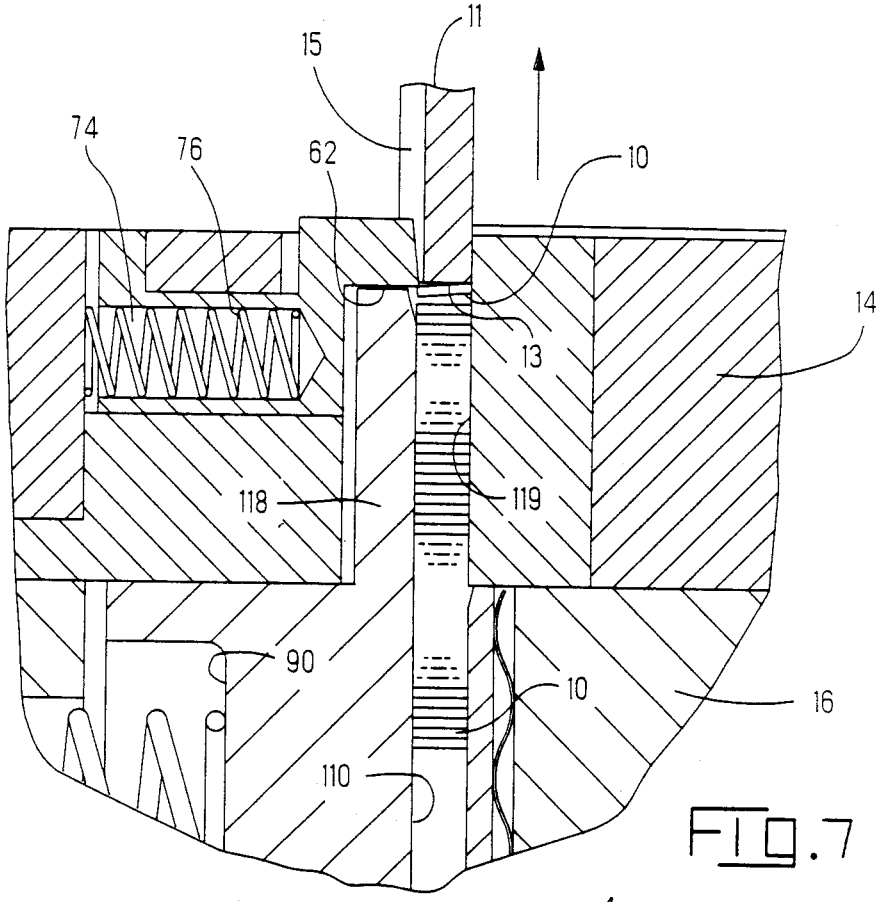

The slug stripper 32 is a machined block having a top surface 52, sides 54, and a triangular projection 56 having convergent side surfaces 58. The edge or apex 61 of the projection 56 slopes rightwardly as viewed in FIGS. 5–7 for reasons explained below. The top surface 60 of this triangular portion is normally above the facial surface 18 of the die block 14 as shown in FIG. 5 and the underside 62 of the triangular projection is against the upper end of a projection 118 of a slug support 78. A transverse recess 64 extends across the slug stripper and receives the connecting neck 72 which extends between two sections of the retainer 34. The two sections of the retaining block 34 define a gap 70 on the underside of this retaining block in which the slug stripper 32 is contained. As shown in FIG. 5, the neck 72 has a width which is narrower than the width of the recess 64 so that the slug stripper 32 can move horizontally leftwardly from the position shown in FIG. 5. Slug stripper 32 is resiliently biased to the position shown in FIG. 5 by a coil spring 76 which is contained in a bore 74 that extends inwardly from the lefthand surface of the slug stripper. The block 34 is held in position on the die block by means of a fastener which extends through a threaded opening 66 in the retaining block and into an opening 68 in the die insert block. A recess is provided as shown at 77, FIG. 5, for the ledge 42 of the die block and in cooperation with the ledge 42, retains the die block securely in its position on the backup plate 16.

Figure 8:
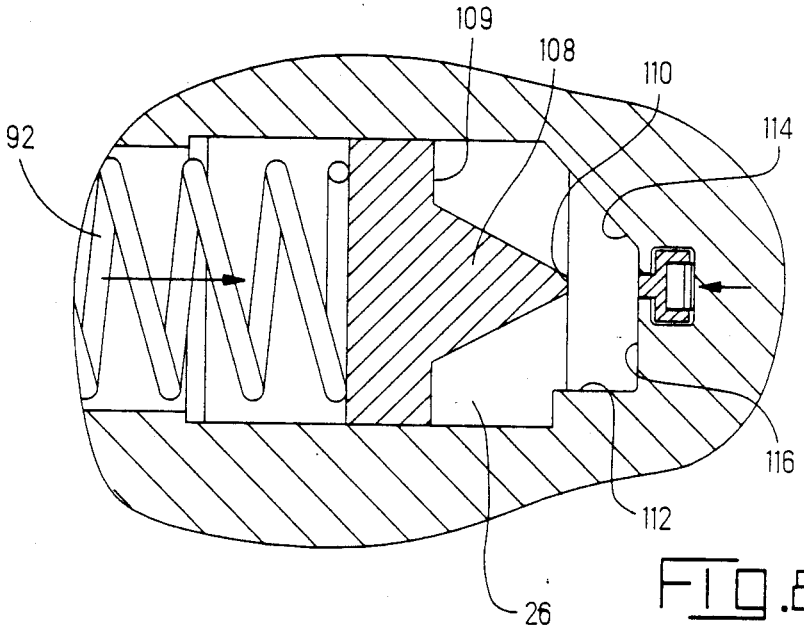
FIG. 8 is a sectional view looking in the direction of the arrows 8—8 of FIG. 6.

The slugs are supported in parallel planes in an orderly stack in the slug passageway 82 by first and second slug supporting bars 78, 80, FIGS. 1, 5, and 8. The first slug supporting bar 78 has a generally rectangular cross-section having one surface 84 which is opposed to a first surface 86 of the opening 26 that extends through the backup plate 16. The second slug supporting bar 80 is contained in the opposite or second surface 87 as will be described below. The first slug supporting bar 78 is pivotally supported for limited arcuate movement at its lower end by the edge of a triangular projection 88 which bears against the surface 86. The first slug support is resiliently biased in a clockwise direction as viewed in FIG. 5 by a spring 92 which extends through a bore 94 in the backup plate, the end of the spring being received in a recess 90 in the surface 84. Spring 92 is retained in position by a plug 96. An additional bore 98 extends through the backup plate to the opening 26 and is counterbored to provide a shoulder as shown at 100. A fastener having an enlarged head 102 is positioned in the counter bore and the shank portion of the fastener 104 extends through the reduced diameter bore section 98. The end of this fastener is threaded as shown at 106 into the first slug supporting bar 78. The arcuate movement of the first slug supporting bar is limited by the enlarged head 102 of this fastener. The first slug supporting bar can be swung leftwardly by a slight distance from the position of FIG. 5 but cannot move rightwardly or clockwise beyond the position of FIG. 5.

The slugs are supported in the passageway by a triangular projection 108, FIG. 8, which extends from the rightwardly facing surface 109 of the slug supporting bar. The edge 110 of this projection bears against the edges of the slugs 10 contained in the passageway and urges the slugs against the surfaces 114, 112 and the inner surface 116 of the passageway 82.

The triangular projection 108 of the first slug supporting bar projects above the upper end 117 of the rectangular portion as shown at and into the die opening 44. This projection 118 serves to engage the edge portions of slugs which are in the die opening and which have not yet entered the passageway 82. The slugs in the die opening are pushed against the opposite surface 119 of the opening and are thereby maintained in an orderly stack.

The second slug supporting bar 80 is generally channel-shaped having a web 122 and sides 124. A rib 120 extends from the web for engagement with the edges of the slugs which are on the opposite sides of the slugs as those edges which are engaged by the edge 110. The channel-shaped portion of the second slug supporting bar is received in a rectangular opening 126 which is adjacent to the passageway 82 and the rib 120 projects through a slot 121 which extends from the side surface 116 of the passageway to the opening 126. A sinuous spring 130 is positioned in the opening 126 and biases the slug supporting bar 80 leftwardly as viewed in FIGS. 8 so that it will normally project beyond the surface 116 in FIG. 8.

The function of the second slug supporting bar 80 is shown in FIGS. 8 and 9. Since the first slug supporting bar 78 is pivoted at its lower end as viewed in the drawing, the apex 110 will not always be vertical but will depart from a vertical orientation by an amount which will depend upon the size of the slugs in the passageway. If small slugs are being produced as shown at 10, the first slug supporting bar will be at the limit of its clockwise travel as viewed in FIG. 5. The passageway 82 will, as a result, be relatively wider in its lower portions than in its upper portions. In other words, because of the fact that the first slug supporting bar is slanted to the right in FIG. 5, the apex 110 will be closer to the side 87 at the upper end of bar 78 than at the bottom of bar 78. The slugs, however, will be of uniform size during a particular run of the press. The slugs would therefore be loosely received in passageway at the lower end thereof if the second slug supporting bar were not provided. The second bar compensates for the slope of the first supporting bar and the distance between the apex 110 and the rib will remain constant along the length of the passageway. As shown in FIG. 9, the rib projects past surface 116 in the lower end of passageway 82 and does not project past surface 116 in FIG. 8.

During continuous operation of a stamping and forming machine in which the invention is installed, the slugs produced are controlled and managed as follows.

At the beginning of an operating cycle, the end 13 of the punch 11 will be spaced from the facial surface of the die plate as shown in FIG. 5 and strip material, which has been recently fed, will be positioned as shown partially extending over the die opening. The strip material 2 will have its edge adjacent the sloping apex 61 of the triangular projection 56 of the slug stripper. As the punch descends to the position of FIG. 6, a slug 10 is punched from the edge portion of the material 2 and pushed into the die opening. As the slug moves downwardly, it engages the inclined apex 61 on the triangular projection of the slug stripper and moves the slug stripper a slight distance to the left as viewed in FIG. 5. The slug is thereby permitted to pass the underside 62 of the slug stripper and move into the die opening. After the slug has been moved past the surface 62, the slug stripper returns to its normal position under the influence of spring 76 and a portion of the apex enters the V-slot 15. If, by any chance, the slug should adhere to the end of the punch, the underside 62 of the apex will engage the slug as it is pulled upwardly and strip it from the end 13 of the punch 11 so that it will remain in the die opening.

The slugs which are in the die opening will be maintained in a neat, orderly stack in planes which are substantially parallel to the facial surface of the die plate. Such maintenance of the slugs is achieved by virtue of the fact that the first slug support 78 is biased in a slight clockwise direction as viewed in FIGS. 6 and 8 so that the apex of the extension 118 bears against the edges of the slugs and confines them thereby preventing them from assuming any orientation other than that shown in the drawing.

During successive operating cycles, the stack of slugs is built up and moves into the passageway 82. The upper end of the rib of the second slug supporting bar is slightly champhered as shown in FIG. 5 so that no difficulty will be encountered when the slugs pass from the die opening into passageway 82. During passage through the passageway 82, the slugs are urged rightwardly by the apex 110 of the triangular projection of the first slug supporting bar and against the surface of the rib 120 of the second slug supporting bar 80. The second slug supporting bar is biased lightly leftwardly, as viewed in FIG. 5, so that if the slugs are stacked entirely through the passageway, the edges will always be engaged by the rib of the second slug supporting bar. The second slug supporting bar is desirable for the reason that the upper portion 118 of the triangular projection pushes the edges of the slugs in the die opening against a fixed wall, the wall 119 of the die opening as shown in FIG. 6. The upper portion 118 will support the slugs against the wall of the die opening regardless of whether the slugs are of minimum size as shown in FIG. 11 or of maximum size as shown in FIG. 12. The portion of the triangular projection which extends through the passageway 82 must also accommodate slugs of the varying sizes shown in FIGS. 11 and 12 and the apex of the triangular projection will not always be perfectly vertical; in other words, the first slug supporting bar will be moved arcuately to a slight extent if the slugs are relatively small as shown in FIG. 12 and its normal position will be displaced in a counter-clockwise direction for relatively large slugs. The passageway 82 must accommodate slugs at both extremes of the dimensional range and this is accomplished by the resiliently biased second slug supporting bar. This bar will yield for relatively larger slugs more than will be the case for smaller slugs.

The invention can be incorporated into a wide variety of stamping and forming machines, including machines of the conventional type in which the die assembly is fixed and the punch assembly reciprocates vertically towards and away from the die assembly. The invention is particularly useful in stamping and forming machines of the type shown in the above-identified U.S. Pat. No. 4,497,196 for the reason that machines of this type have very compact die assemblies and it is impractical to provide suction systems for removing the slugs. Furthermore, since these machines are horizontal rather than vertical, the forces of gravity are not present to assist in slug removal. In the accompanying drawing, the punch is shown as being reciprocable in a vertical direction; however, it is to be understood that the punch in a machine of the type referred to above will be moving horizontally.

We claim:

1. A punch assembly and a die assembly which are intended for mounting in a press for punching openings in a strip of material which is intermittently fed along a strip feed path, the die assembly having a facial surface and having a die opening extending into the facial surface, a slug receiving passageway extending through the die assembly from the die opening to a slug outlet, the passageway being in alignment with the die opening, the punch assembly being in opposed relationship to the die assembly and having a punch extending therefrom, the punch having a free end which is dimensioned to be received in the die opening, the punch and die assemblies being reciprocable relatively towards and away from each other between open and closed positions, the strip feed path extending between the punch and die assemblies whereby upon reciprocation of the punch and die assemblies relatively towards and away from each other during a non-feeding interval of the strip material, a flat slug will be punched from the strip by the free end of the punch and will be pushed into, and through, the die opening and through the passageway to the outlet, the punch and die assemblies being characterized in that:

the die opening overlaps one side edge of the strip material on the strip feed path so that notches are produced in the one edge during continuous operation of the press, a slug stripper is provided for ensuring that a slug does not adhere to the free end of the punch when the punch assembly returns to its open position, and slug supporting means are provided in the passageway, the slug stripper is mounted in the facial surface of the die assembly and is resiliently biased to a normal position in which an end portion of the slug stripper extends partially across the die opening, the slug stripper being retractable to a retracted position, and the punch has a recess therein which is located and dimensioned to receive the end portion of the slug stripper, the slug supporting means extends from a location adjacent to the die opening through the passageway towards a slug outlet whereby, during continuous operation of the press, any slugs which may adhere to the punch will be stripped from the free end of the punch by the slug stripper and the slugs in the passageway will be maintained in parallel planes in an orderly stack.

2. A punch assembly and a die assembly as set forth in claim 1 characterized in that the die opening and the passageway have a first side which is beside, and spaced from, the strip feed path and having a second side which is on the strip feed path, the slug supporting means comprising a first slug supporting bar which extends along the first side of the passageway to the outlet, the first bar being resiliently biased towards the second side whereby slugs in the passageway are urged against the second side by the first bar.

3. A punch assembly and a die assembly as set forth in claim 2 characterized in that a second slug supporting bar is provided which extends axially along the passageway on the second side thereof, the second slug supporting bar being resiliently biased towards the first slug supporting bar whereby slugs in the passageway are supported between the first and second slug supporting bars.

4. A punch assembly and a die assembly as set forth in claim 2 characterized in that the first slug supporting bar has an extension which extends into the die opening whereby each slug is supported in the die opening by the extension.

5. A punch assembly and a die assembly as set forth in claim 4 characterized in that a second slug supporting bar is provided which extends axially along the passageway on the second side thereof, the second slug supporting bar being resiliently biased towards the first slug supporting bar whereby slugs in the passageway are supported between the first and second slug supporting bars.

6. A punch assembly and a die assembly as set forth in claim 5 characterized in that the first slug supporting bar is pivotally supported at a location spaced from the die opening for arcuate movement towards the second side.

7. A punch assembly and a die assembly as set forth in claim 2 characterized in that the die opening and the passageway have one side which is beside, and spaced from, the strip feed path and have a second side which is on the strip feed path, the die assembly comprising a die plate and a die backup plate, the facial surface being one surface of the die plate, the die backup plate being against the other surface of the die plate, the die opening extending through the die plate and the passageway extending through the backup plate, the slug supporting means comprising first and second slug supporting bars which extend along the first and second sides respectively, the second slug supporting bar being entirely contained in the passageway, the first slug supporting bar having an extension which extends into the die opening, the first slug supporting bar being pivoted at a location spaced from the die opening for arcuate movement towards and second slug supporting bar, and the first and second slug supporting bars are resiliently biased towards each other whereby slugs in the die opening are supported by the extension on the first slug supporting bar, and slugs in the passageway are supported between the first and second slug supporting bars.

8. A punch assembly and a die assembly as set forth in either of claim 1 or 7 characterized in that the die assembly has a recess to the facial surface thereof, the recess extending from a location beside the die opening to the die opening, the slug stripper being contained in the recess, and a spring is provided in the recess which biases the slug stripper to its normal position.

9. A punch assembly and a die assembly which are intended to be mounted in a press for punching notches in one side edge of a strip of material which is intermittently fed along a strip feed path, the die assembly having a facial surface and having a die opening extending into the facial surface, the punch assembly being in opposed relationship to the die assembly and having a punch extending therefrom, the punch having a free end which is dimensioned to be received in the die opening, the punch and die assemblies being reciprocable relatively towards and away from each other between open and closed positions, the strip feed path extending between the punch and die assemblies and partially over the die opening whereby upon reciprocation of the punch and die assemblies relatively towards and away from each other during a non-feeding interval, a slug will be punched from the one side edge of the strip by the free end of the punch and be pushed into the die opening, the punch and die assemblies being characterized in that:

a slug stripper is provided for ensuring that the slug does not adhere to the free end of the punch when the punch assembly returns to its open position, the slug stripper being mounted in the die assembly at a location beside the strip feed path and having an end portion which normally extends laterally of the strip feed path and past the one side edge, the slug stripper being resiliently biased to its normal position and being retractable to a retracted position, the punch has an axially extending recess extending from its free end partially along its length, the recess being located and dimensioned to receive the end portion of the slug stripper whereby, during a complete operating cycle, the punch and die assemblies move relatively towards and away from each other and a slug is punched from the edge of the strip, and during movement of the slug into the die opening, the slug moves the slug stripper to its retracted position, and the slug stripper returns to its normal position after the slug moves past the end portion of the slug stripper, the end portion of the slug stripper being received in the recess so that upon return of the punch to its open position, if a slug is adhered to the free end of the punch, the slug stripper will strip the slug from the punch and retain it in the die opening.

10. A punch assembly and a die assembly as set forth in claim 9 characterized in that the die assembly has a recess in the facial surface thereof, the recess extending from a location beside the strip feed path to the die opening, the slug stripper being contained in the recess, and a spring is provided in the recess which biases the slug stripper to its normal position.

11. A punch assembly and a die assembly as set forth in claim 10 characterized in that a slug receiving passageway extends from a location adjacent to the die opening through the die assembly to an outlet whereby slugs punched from the strip are pushed from the die opening through the passageway, and slug supporting means are provided in the passageway for supporting slugs in the passageway in an orderly stack with the slugs in parallel planes which extend parallel to the facial surface.

12. A punch assembly and a die assembly as set forth in claim 10 characterized in that the slug stripper has a triangular projection extending towards the die opening, the end portion being the end portion of the projection including the apex thereof, the recess in the punch comprising a V-shaped groove.

13. A punch assembly and a die assembly as set forth in claim 12 characterized in that the triangular projection has a top surface which is parallel to, and above, the facial surface, the apex extending downwardly towards the facial surface and being inclined towards the strip feed path.

14. A die assembly which is intended for use with a punch assembly in a punch and die set, the punch and die set being installed in a press, the die assembly having a facial surface and having a die opening in the facial surface, a passageway extending through the die assembly from the die opening to an outlet, the die assembly being in opposed relationship to the punch assembly, the punch assembly having a punch thereon which is dimensioned to enter the die opening whereby upon intermittently feeding strip material along a strip feed path which extends between the punch and die assemblies, and upon reciprocation of the punch and die assemblies relatively towards and away from each other during non-feeding intervals, slugs will be punched out of the strip material and the slugs will be pushed by the punch into the die opening, the die assembly being characterized in that:

the die opening is located on one side edge of the strip feed path and overlaps the strip feed path so that a notch is formed on the one side edge of the strip by the punch and die, the die opening and the passageway having a first side which is beside, and spaced from, the strip feed path and having a second side which is on the strip feed path and opposite to the first side, slug supporting means are provided in the passageway, the slug supporting means comprising first and second slug supporting bars which extend along the first and second sides of the passageway, each of the slug supporting bars being resiliently biased towards the axis of the passageway whereby, during operation of the press, the slugs produced are pushed into the die opening and into the passageway and the first and second slug supporting bars will engage opposite edge portions of the slugs and maintain the slugs in an orderly stack in parallel planes.

15. A die assembly as set forth in claim 14 characterized in that the die assembly comprises a die plate and a die backup plate, the facial surface being one surface of the die plate, the die backup plate being against the other surface of the die plate, the die opening extending through the die plate, the passageway extending through the backup plate, the second slug supporting bar being entirely in the backup plate, the first slug supporting bar being in the backup plate and having an extension which extends into the die opening whereby, each slug is supported in the die opening by the extension on the first supporting bar.

16. A die assembly as set forth in claim 15 characterized in that the die assembly comprises a slug stripper for stripping a slug from the end of the punch in the event that a slug adheres to the end of the punch, the slug stripper having an end portion which extends partially across the die opening.

17. A die assembly as set forth in either of claims 21 or 15 characterized in that the first slug supporting bar has a remote end which is remote from the die opening, the first slug supporting bar being pivotally supported at its remote end for arcuate movement towards and way from the axis of the passageway.

18. A punch and die assembly as set forth in any of claims 1, 9, or 14 characterized in that the punch and die assembly each move horizontally towards and away from each other.

* * * * *

UNITED STATES PATENT AND TRADEMARK OFFICE

CERTIFICATE OF CORRECTION

PATENT NO. : 4,974,479

DATED : December 4, 1990

INVENTOR(S) : Johannes C.W. Bakermans, John D. Deimler, Ronnie W. Reavis

It is certified that error appears in the above-identified patent and that said Letters Patent is hereby corrected as shown below:

In claim 17, column 12, lines 17-18, change "claims 21 or 15" to read --claims 14 or 15--.

In claim 17, column 12, line 22, the word "way" should be --away--.

Signed and Sealed this

Fifth Day of May, 1992

*Attest:*

DOUGLAS B. COMER

*Attesting Officer*

*Acting Commissioner of Patents and Trademarks*